US005565222A

United States Patent [19]

Scherer

[11] Patent Number: 5,565,222

[45] Date of Patent: Oct. 15, 1996

[54] APPARATUS FOR HEMMING EDGES OF STRETCH FILM AND FILM HAVING HEMMED EDGES

[75] Inventor: Philip G. Scherer, Fort Lauderdale, Fla.

[73] Assignee: Mima Incorporated, Glenview, Ill.

[21] Appl. No.: 378,649

[22] Filed: Apr. 20, 1995

Related U.S. Application Data

[62] Division of Ser. No. 103,588, Aug. 9, 1993, abandoned.

[51] Int. Cl.[6] ..... B29C 61/10

[52] U.S. Cl. ..... 425/500; 156/202; 156/465

[58] Field of Search ..... 156/202, 465; 425/500

[56] References Cited

U.S. PATENT DOCUMENTS 2,696,865 12/1954 Seiler ..... 156/202

4,488,927 12/1984 Hooper ..... 156/465

*Primary Examiner*—Tim Heitbrink

*Attorney, Agent, or Firm*—Schwartz & Weinrieb

[57] ABSTRACT

A strip of stretch-wrap material having flat, double thickness hems at opposite margins thereof is disclosed. The hemmed strip is formed on apparatus including a first roller having a width less than the width of stock material fed into the machine, whereby opposite margins of the stock material project beyond opposite ends of the roller, and a second roller for guiding the strip at an acute angle from the first roller for causing the opposite marginal portions to fold. The strip is maintained under tension by a take-up roller or other means, and guide bars are provided for further folding the marginal portions beyond 90° angles so that they continue to be folded inwardly against the main body of the strip.

14 Claims, 1 Drawing Sheet

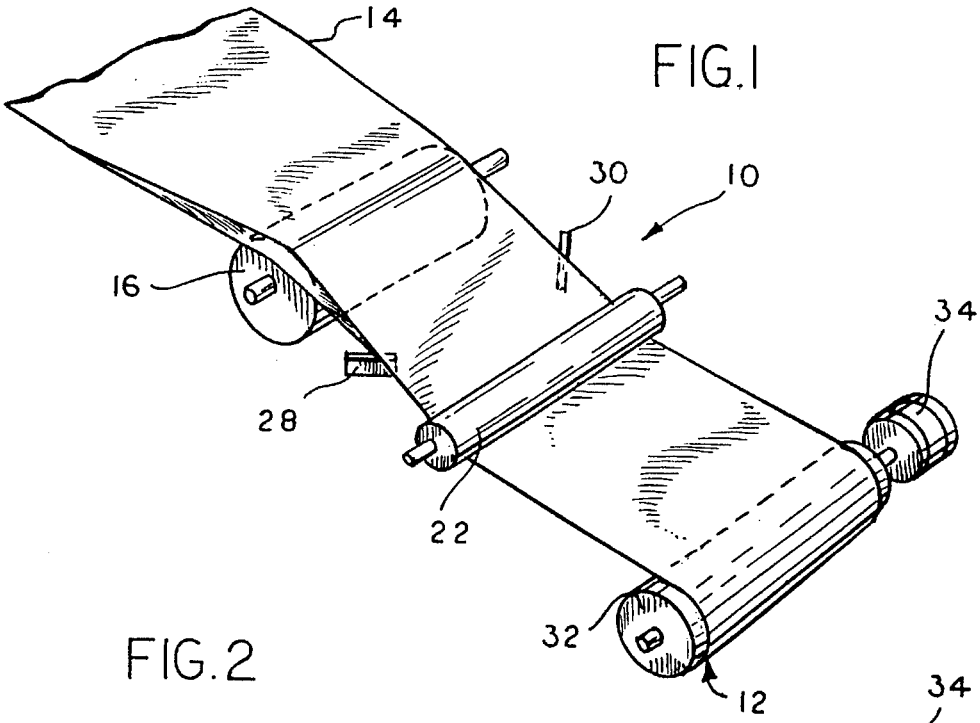
FIG.1
FIG.2
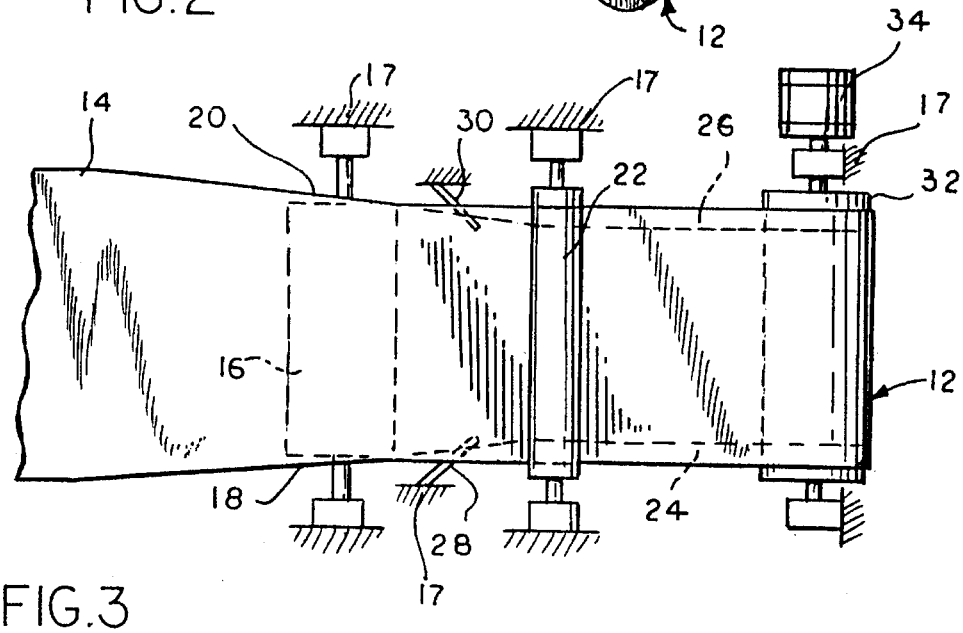
FIG.3
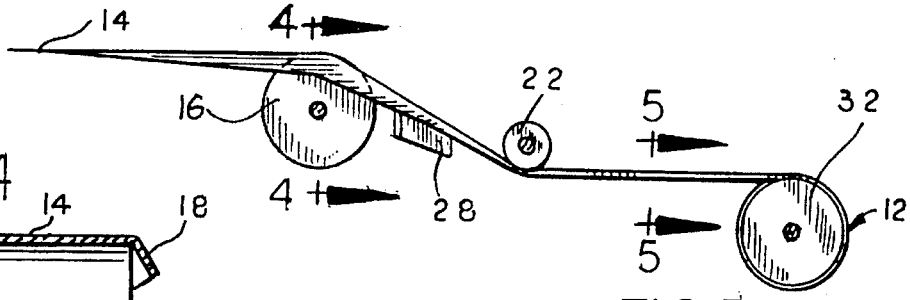
FIG.4
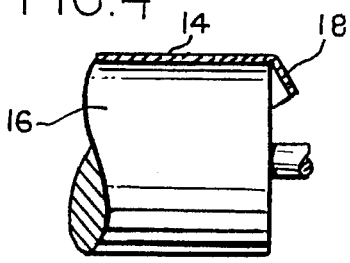
FIG.5
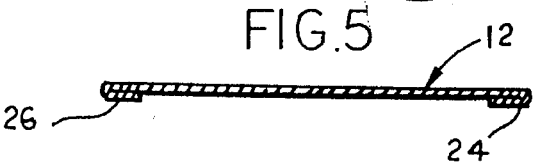

APPARATUS FOR HEMMING EDGES OF STRETCH FILM AND FILM HAVING HEMMED EDGES

This application is a division of application Ser. No. 08/103,588, filed Aug. 9, 1993 now abandoned.

FIELD OF THE INVENTION

The present invention relates to a stretch film and a method and apparatus for reinforcing edges of such a film.

BACKGROUND OF THE INVENTION

Thin strips of elastic stretchable plastic material have become widely used for wrapping goods or boxes of goods to be stored or shipped. For example, it is common practice to stack a plurality of boxes on a pallet for shipping and to secure the boxes together, and with respect to the pallet, by wrapping them with a film or strip of resilient plastic material or, in other words, a stretch-wrap. Such stretch-wrapped materials are quite thin and are subject to rupturing or tearing at the edges, particularly in situations where the goods being wrapped have relatively sharp corners or uneven surfaces. Heretofore, it has been suggested to reinforce the edges of such stretch-wrapped materials by gathering or bunching the edges together so as to provide a so-called hem. While such hemming is effective for reinforcing the edges, the bunching may be uneven in appearance and effectiveness and provides ribs or ridges in the ultimate package, which may be objectionable.

OBJECTS OF THE INVENTION

It is an object of the present invention to provide a novel film or strip of stretch-wrap material having a marginal hem which is substantially smooth and flat, as distinguished from a bunching or gathering of material.

A further object of the present invention is to provide a novel method and apparatus for efficiently and economically producing a hemmed, stretch-wrap film of the above-described type.

A still further specific object of the present invention is to provide a novel apparatus for producing a hemmed, stretch-wrap film, which apparatus is of simple and economical construction and may be used with other apparatus which initially produces an unhemmed film, and which also may be used to hem a film pulled from a pre-existing roll of the product.

SUMMARY OF THE INVENTION

A stretch-wrap film in accordance with the present invention is formed with marginal hems which are flat and unbunched and simply comprise two flat layers of material joined along a fold line. In order to form the hems, an unhemmed strip of film is pulled over a roller having a width less than the width of the strip, so that margins of the strip project beyond opposite ends of the roller. Means is provided for guiding the strip away from the roller at an angle with respect to the plane of the strip approaching the roller for causing the margins to fold through an acute angle over the ends of the roller so as to initiate the forming of the hems. Additional members are positioned adjacent the path of travel of the strip for engaging the partially folded margins for causing the margins to complete the folding action through 180°, and a pressing roller is disposed for ensuring flattening of the strip and the hems.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIG. 1 is a simplified perspective view showing an apparatus for forming a hemmed film or strip in accordance with the method of the present invention;

FIG. 2 is a plan view of the apparatus shown in FIG. 1;

FIG. 3 is a side elevational view of the apparatus shown in FIG. 1;

FIG. 4 is an enlarged fragmentary sectional view taken along line 4—4 in FIG. 3; and FIG. 5 is an enlarged sectional view taken along line 5—5 in FIG. 3.

DESCRIPTION OF AN ILLUSTRATIVE EMBODIMENT

Referring now more specifically to the drawings, wherein like parts are designated by the same numerals throughout the various figures, an apparatus 10 for forming a hemmed, stretch-wrap film or strip 12 in accordance with the present invention is shown in a simplified and somewhat schematic form in FIGS. 1 through 3. The apparatus is supplied with a strip or film 14 of resiliently stretchable plastic stretch-wrap stock material of any known composition. For example, such films are often composed of polyethylene, polyvinyl chloride, ethylene vinyl acetate, ethylene methyl acetate, and ethylene copolymers with higher alpha olefins. The film or strip 14 of stock material is delivered from a suitable source of supply, not shown, which source may be a film-producing extruding apparatus or the like of known construction, or a roll of previously formed, unhemmed sheet material.

In accordance with the present invention, the flat strip 14 advances to the apparatus 10 along a first path of travel disposed in a first plane and passes over a first guide member or hemming roller 16 rotatably mounted on a suitable frame 17. As shown best in FIGS. 1 and 2, the strip 14 has a predetermined initial width which is greater than the length of the guide member or roller 16. As a result, opposite marginal portions 18 and 20 of the strip 14 project outwardly beyond opposite ends of the roller 16.

A second hemming or pressing member or roller 22 is rotatably mounted on the frame 17 in the apparatus 10 downstream from the roller 16 and at a location for directing the strip 14 passing over the roller 16 downwardly along a path of travel in a plane disposed at an acute angle with respect to the plane of the incoming portion of the strip 14. The strip 14 is maintained under tension, as will be discussed below, and as a result of such tension and the angular relationship between the portions of the strip approaching and leaving the roller 16, the margins 18 and 20 are folded downwardly through acute angles over the opposite ends of the roller 16 so as to initiate the hemming process, as shown in FIG. 4. It has been found that the optimum deflection angle of the film passing over the roller 16 is approximately 20°–30°. This arrangement causes the marginal portions 18 and 20 to fold through an acute angle approaching 90°.

In order to complete folding of the marginal portions 18 and 20 so as to form opposite marginal hems 24 and 26, guide bars or folding members 28 and 30 are mounted on the frame 17 adjacent the path of travel of the film at locations between the rollers 16 and 22. The guide bars 28 and 30 are constructed for engaging the partially folded marginal portions 18 and 20 and guiding them beyond a 90° angle. It has been found that once the marginal portions 18 and 20 are folded beyond 90°, they will continue to fold through a full 180° to provide the flat double thickness hems 24 and 26. The pressure applied to the film 14 by the roller 22 ensures that the film 14 and the hems 24 and 26 will remain in a substantially flat condition.

In the apparatus shown for illustrating the present invention, a take-up roller 32, driven by a motor 34, is provided. While the rollers 16 and 22 are idler rollers, the roller 32 is driven at a speed sufficient to maintain the stock material strip 14 and the finally hemmed film or strip 12 under tension for causing the folding of the marginal portions 18 and 20, as discussed above. It is noted however, that the hemmed strip could be maintained under tension in different ways. For example, the guide members or rollers 16 and 22 and the guide bars 28 and 30 could be incorporated into a machine or hand-held unit of known construction, not shown, for applying the stretch-wrap material to products to be wrapped, and the desired tension could be maintained by anchoring an end of the hemmed film 12 to the goods and then pulling the strip through the rollers and guide bars as the strip is wound around the goods.

While a preferred embodiment of the present invention has been shown and described herein, various modifications may be made without departing from the spirit and scope of the appended claims.

The invention is claimed as follows:

1. Apparatus for hemming a strip of plastic film maintained under tension and moving along a first predetermined path of travel, comprising:

a first guide means disposed transversely with respect to said first predetermined path of travel for engaging a first side of said film and having at least one end thereof disposed inwardly of an adjacent edge of said film so that a marginal edge portion of said film projects beyond said at least one end of said first guide means;

a second guide means disposed downstream of said first guide means, as considered along said first predetermined path of travel, for pressing against a second side of said film which is opposite from said first side of said film and for causing said film to be directed at an acute angle with respect to said first predetermined path of travel so as to cause said marginal edge portion of said film to be initially folded over said at least one end of said first guide means at an acute angle with respect to the plane of said film; and folding means positioned between said first and second guide means for further folding said initially folded marginal portion toward a final folded position of 180° with respect to said film so as to form a substantially flat hem along said edge of said film.

2. An apparatus, as defined in claim 1, which includes a driven roller disposed downstream from said second guide means for pulling said film over said first and second guide means and maintaining said film under tension.

3. An apparatus, as defined in claim 2, wherein said first and second guide means are idler rollers.

4. An apparatus, as defined in claim 2, wherein said driven roller comprises means for winding said strip of film into a roll.

5. Apparatus as set forth in claim 1, wherein:

said acute angle at which said strip of film is directed is within the range of 20°–30°.

6. Apparatus as set forth in claim 1, wherein:

said acute angle at which said marginal portion is initially folded approaches 90°.

7. Apparatus as set forth in claim 1, wherein:

said strip of film comprises a resiliently stretchable, plastic stretch-wrap material.

8. Apparatus as set forth in claim 7, wherein:

said material comprises one of polyethylene, polyvinyl chloride, ethylene vinyl acetate, ethylene methyl acetate, and ethylene vinyl copolymers with higher alpha olefins.

9. Apparatus for hemming a strip of plastic film of a predetermined width, maintained under tension, and moving along a first predetermined planar path of travel, comprising:

a first idler roller disposed transversely with respect to said first predetermined planar path of travel and engaging a first side of said film, said first idler roller having a length which is less than said predetermined width of said plastic film and being positioned with respect to said plastic film so that opposite marginal edge portions of said film project laterally beyond opposite ends of said first idler roller;

a second idler roller disposed downstream of said first idler roller, as considered along said first predetermined path of travel, and engaging a second side of said film which is opposite said first side of said film for causing said film conducted from said first idler roller to be directed along a second path of travel which is disposed at an acute angle with respect to said first path of travel whereby said marginal edge portions of said strip of film projecting laterally beyond said opposite ends of said first idler roller are caused to be initially folded about said opposite ends of said first idler roller at an acute angle with respect to the remainder of said film strip; and guide bars positioned between said first and second idler rollers for engaging said initially folded marginal edge portions and further folding said initially folded marginal edge portions beyond a 90° angle with respect to said remainder of said film strip for thereby causing said marginal edge portions to assume a final folded position of 180° with respect to said remainder of said film strip so as to provide double thickness hems at opposite margins of said strip.

10. An apparatus, as defined in claim 9, which includes a driven roller downstream from said second roller for pulling said strip and maintaining the strip under tension.

11. Apparatus as set forth in claim 10, wherein:

said acute angle at which said strip of film is directed is within the range of 20°–30°.

12. Apparatus as set forth in claim 10, wherein:

said acute angle at which said marginal portions are initially folded approaches 90°.

13. Apparatus as set forth in claim 10, wherein:

said strip of film comprises a resiliently stretchable, plastic stretch-wrap material.

14. Apparatus as set forth in claim 13, wherein:

said material comprises one of polyethylene, polyvinyl chloride, ethylene vinyl acetate, ethylene methyl acetate, and ethylene vinyl copolymers with higher alpha olefins.

* * * * *